US011918123B2

(12) United States Patent
Zhu

(10) Patent No.: US 11,918,123 B2
(45) Date of Patent: Mar. 5, 2024

(54) CONNECTING MEMBER, FASTENING MEMBER, AND CAMP BED USING CONNECTING MEMBER AND FASTENING MEMBER

(71) Applicant: Feijun Zhu, Ningbo (CN)

(72) Inventor: Feijun Zhu, Ningbo (CN)

( * ) Notice: Subject to any disclaimer, the term of this patent is extended or adjusted under 35 U.S.C. 154(b) by 243 days.

(21) Appl. No.: 17/597,670

(22) PCT Filed: Nov. 18, 2019

(86) PCT No.: PCT/CN2019/119121
§ 371 (c)(1),
(2) Date: Jan. 18, 2022

(87) PCT Pub. No.: WO2021/012536
PCT Pub. Date: Jan. 28, 2021

(65) Prior Publication Data

US 2022/0248869 A1 Aug. 11, 2022

(30) Foreign Application Priority Data

Jul. 19, 2019 (CN) ..... 201921147797.2
Sep. 29, 2019 (CN) ..... 201921648719.0

(51) Int. Cl.
*A47C 31/02* (2006.01)
*A47C 17/64* (2006.01)
*A47C 17/86* (2006.01)

(52) U.S. Cl.
CPC ..... *A47C 31/023* (2013.01); *A47C 17/64* (2013.01); *A47C 17/645* (2013.01); *A47C 17/86* (2013.01); *A47C 31/02* (2013.01)

(58) Field of Classification Search
CPC ..... A47C 31/023; A47C 31/02; A47C 17/64; A47C 17/645; A47C 17/84; A47C 17/86
(Continued)

(56) References Cited

U.S. PATENT DOCUMENTS 8,806,675 B2 * 8/2014 Lah ..... A47C 19/00 5/116
D848,828 S * 5/2019 Zhu ..... D8/382
(Continued)

FOREIGN PATENT DOCUMENTS

EP 2727499 A1 * 5/2014 ..... A47C 17/64
WO WO-2017069477 A1 * 4/2017 ..... A47C 17/64
(Continued)

*Primary Examiner* — Robert G Santos
(74) *Attorney, Agent, or Firm* — Wang Law Firm, Inc.

(57) ABSTRACT

A connecting piece (100) comprises a first body (101), two supporting legs (102) respectively connected to the left and right sides of the first body (101), a supporting arm (103) connected to the first body (101) and extends upward; the first body (101) has a first mounting hole (1011) opening forward; the supporting arm (103) has a second mounting hole (1031). It is convenient to assemble and simplifies the connection operation of a cot. A tensioning piece comprises a second body (201), a clamping portion (202), the second body (201) has a connecting hole (2011), the clamping portion (202) has an opening (2021) for clamping onto a side rod (400) of the cot, and the opening (2021) is arc-shaped. So it can be easily disassembled and assembled without additional tools. And a cot is convenient to store and disassemble and assemble.

10 Claims, 5 Drawing Sheets

(58) Field of Classification Search
USPC ..... 5/110–112, 114
See application file for complete search history.

(56) References Cited

U.S. PATENT DOCUMENTS

| | | | | |
|---|---|---|---|---|
| D848,829 | S * | 5/2019 | Zhu | D8/382 |
| 10,342,351 | B2 * | 7/2019 | Lenhart | A47C 4/286 |
| 11,076,702 | B2 * | 8/2021 | Zhang | A47C 17/645 |
| 11,576,496 | B2 * | 2/2023 | Zhu | A47C 17/66 |
| 2014/0115780 | A1 * | 5/2014 | Lah | A47C 19/12 5/111 |
| 2017/0311723 | A1 * | 11/2017 | Lenhart | A47C 4/42 |
| 2021/0127844 | A1 * | 5/2021 | Zhang | A47C 17/74 |
| 2022/0225782 | A1 * | 7/2022 | Zhu | A47C 17/66 |
| 2022/0248869 | A1 * | 8/2022 | Zhu | A47C 31/023 |
| 2023/0389709 | A1 * | 12/2023 | Maxfield | A47C 17/645 |

FOREIGN PATENT DOCUMENTS

| | | | | |
|---|---|---|---|---|
| WO | WO-2021012536 | A1 * | 1/2021 | A47C 17/64 |
| WO | WO-2021258499 | A1 * | 12/2021 | |

* cited by examiner

CONNECTING MEMBER, FASTENING MEMBER, AND CAMP BED USING CONNECTING MEMBER AND FASTENING MEMBER

TECHNICAL FIELD OF THE INVENTION

The present invention relates to the technical field of cots, in particular to a connecting piece and a tensioning piece for constructing a cot framework, and a cot thereof.

BACKGROUND OF THE INVENTION

Cots are popular among field workers, camping enthusiasts and office workers due to characteristics of easy collection, convenience for use and small occupied space during storage and transportation. When it is necessary to rest, a cot can be quickly mounted for rest.

As for a Chinese patent CN2607888Y (patent NO.: 02255564.1) titled "A Fully Folding Cot" and a Chinese patent CN203153120U (patent NO.: 201320119056.X) titled "Multi-functional Folding Cot", the supporting structures of the cots disclosed therein are formed by splicing a plurality of connecting pieces and supporting rods. Such supporting structures use many connecting pieces, the connection of the supporting rods is complicated, and the splicing process takes a long time. Besides, some of the connecting pieces in these supporting structures are located at the bottom of the whole supporting structure, but in order to reduce the cost, the connecting pieces are usually made of plastic, so that the connecting pieces are prone to wearing in the long-term use process, which directly affects the stability of the connection of the supporting rods, thus making the cot unreliable and posing potential safety hazards.

As for a Chinese patent CN 201861198 U (patent NO.: 201020578241.1) titled "Novel Camp Bed", the camp bed disclosed therein comprises a frame, two side tubes, side face tubes and bed cloth. Both ends of the frame are connected with the two side tubes and the side face tubes through L-shaped connecting pieces, the middle of the frame is connected with the side face tubes through T-shaped connecting pieces, and the bed cloth is fixed to the two side tubes and the side face tubes. The intersection of two metal tubes of the frame is fixed with rivets and supported and connected by rubber blocks. The two metal tubes of the frame are hexagonal deformed steel tubes, and the two metal tubes are buckled with rivets to form a scissors-type supporting structure. In the camp bed with such a structure, the frame is connected with all the side face tubes through the connecting pieces, which makes the camp bed not facilitate regular disassembly and assembly, and causes troublesome operation, and special tools are required in the process of disassembly and assembly. In addition, when the camp bed is stored, small-volume storage is not facilitated due to the structural characteristics of the frame itself.

SUMMARY OF THE INVENTION

It is a first object of the present invention to provide a connecting piece which is convenient to assemble and simplifies the connection operation of supporting rods of a cot.

It is a second object of the present invention to provide a tensioning piece which can be easily disassembled and assembled without additional tools, thus simplifying the disassembling and assembling operations of a cot.

It is a third object of the present invention to provide a cot which is convenient to store and disassemble and assemble.

It is a fourth object of the present invention to provide a cot which is convenient to assemble.

It is a fifth object of the present invention to provide a cot with adjustable height as required.

For achieving the first object, the connecting piece comprises a first body having a left side and a right side; two supporting legs respectively connected to the left and right sides of the first body; a supporting arm connected to the first body and extends upward;

the first body has a first mounting hole opening forward with an axis extending along the horizontal direction;

the supporting arm has a second mounting hole opening backward with an axis inclined upward relative to the horizontal direction.

Preferably, the supporting arm is located at the rear of the first body and inclines upward and backward relative to the horizontal direction.

In order to avoid the situation that a connecting rod cannot be mounted in place due to the air pressure in the first mounting hole when the connecting rod is mounted, preferably, the first body has a first small hole at the end of the first mounting hole.

In order to increase the structural firmness and the connection strength of the supporting arm on the first body, preferably, a reinforcing rib is connected between the first body and the surface of the supporting arm.

In order to improve the support stability while reducing the friction to the connecting piece, preferably, the first body has a supporting base at the bottom of the first body, and the bottom of the supporting base and the bottom of each supporting leg are on the same horizontal plan.

In order to improve the support stability of the supporting legs, preferably, each supporting leg has a low portion which is distributed inclined outward.

In order to facilitate connection of cot legs for adjusting the height of the cot, preferably, each supporting leg has a third mounting hole opening downward.

In order to avoid the situation that the connecting rod cannot be mounted in place due to the air pressure in the third mounting hole when the cot leg is mounted, preferably, each supporting leg has a second small hole at the end of the third mounting hole.

For achieving the second object, the tensioning piece for connecting to a cot comprises a second body and a clamping portion connected to the second body; wherein, the second body has a connecting hole for receiving a supporting rod of the cot, the clamping portion has an opening for clamping onto a side rod of the cot, and the opening is arc-shaped.

In order to ensure the connection stability, preferably, the radius of an inner wall of the opening of the clamping portion matches with the radius of the side rod of the cot.

In order to improve the connection firmness, preferably, the clamping portion is made of a material with elastic capacity, and the width of the top of the opening is smaller than the diameter of the side rod of the cot.

In order to better support the side rod of the cot, preferably, the clamping portion is extending upward from the top of the second body, and the center of the inner wall of the opening of the clamping portion is located outside the axis of the second body.

In order to increase the supporting strength of the clamping portion, preferably, a reinforcing portion is connected between the outer surface of the clamping portion and the second body.

Optionally, the radian of the inner wall of the opening is between 90-170 degrees.

For achieving the third object, the cot comprises a connection frame, a cot fabric and a plurality of tensioning pieces.

Two side rods are respectively disposed at two sides of the cot fabric, the second body of each tensioning piece is connected to the top of the connection frame, and the clamping portion of each tensioning piece is connected to the side rods so as to fasten the cot fabric.

In order to simplify the structure, preferably, the connection frame comprises at least two joints, and a plurality of supporting rods are connected between two adjacent joints;

each joint has a first connecting protrusion, a second connecting protrusion, a third connecting protrusion, a fourth connecting protrusion and a fifth connecting protrusion, each for receiving the supporting rod;

the first connecting protrusion and the second connecting protrusion extend and incline upward relative to the horizontal, and an included angle is defined between the central axes of the first connecting protrusion and the second connecting protrusion which are bilateral symmetric;

the third connecting protrusion and the fourth connecting protrusion extend and incline downward relative to the horizontal, and an included angle is defined between the central axes of the third connecting protrusion and the fourth connecting protrusion which are bilateral symmetric;

the fifth connecting protrusion extends horizontally forward and/or backward.

For achieving the fourth object, the cot comprises a cot fabric, a supporting rod assembly, a plurality of connecting pieces and a plurality of tensioning pieces located above the connecting pieces;

at least two pairs of connecting pieces are disposed face to face, and each pair of connecting piece is distributed at intervals along the length of the cot fabric;

two side rods are respectively disposed at two sides of the cot fabric;

the supporting rod assembly comprises a plurality of connecting rods each connected between each pair of connecting pieces, and a plurality of supporting rods each connected between the connecting piece and the corresponding side rod;

the two ends of each connecting rod are respectively inserted into the first mounting hole of the connecting pieces;

the two ends of the supporting rods are respectively inserted into the connecting hole of the tensioning piece and the second mounting hole of the connecting piece; each side rod is clamped inside the opening of the clamping portion of each tensioning piece so as to fasten the cot fabric.

For achieving the fifth object, the supporting rod assembly further comprises a plurality of cot legs detachably connected to the supporting legs and extend downward.

Compared with the prior art, the present invention has the following advantages:

The connecting piece in the present invention can be symmetrically disposed on both sides of the cot, each connecting rod is connected in the first mounting holes of two connecting pieces to form support in the width direction of the cot, and the supporting rods are connected in the second mounting holes of the connecting pieces to support the cot on both sides of the cot. Thus, when the cot using the connecting pieces is assembled, fewer connecting pieces, and fewer parts for assembly are required, having high connection speed, simple connection mode, easy operation and good stability during use. Moreover, a cot applying the connecting pieces is convenient to disassemble and assemble, carry and store, which makes the application range of the cot wider.

The tensioning piece in the present invention has a simple structure. When the cot is disassembled and assembled, the tensioning pieces can be conveniently disassembled from the side rods of the cot, and can also be clamped on the side rods of the cot under a small acting force, so that the tensioning pieces and the side rods of the cot can be disassembled and assembled more conveniently, which can be easily completed by a female with small strength, without the need of additional tools during operation, and the application range is wider.

In addition, as for a cot using the tensioning pieces in the present invention, the cot can be supported with fewer connecting components; and when in use, it is very convenient to disassemble and assemble, and store and carry.

DETAILED DESCRIPTION OF THE INVENTION

Figure 1:
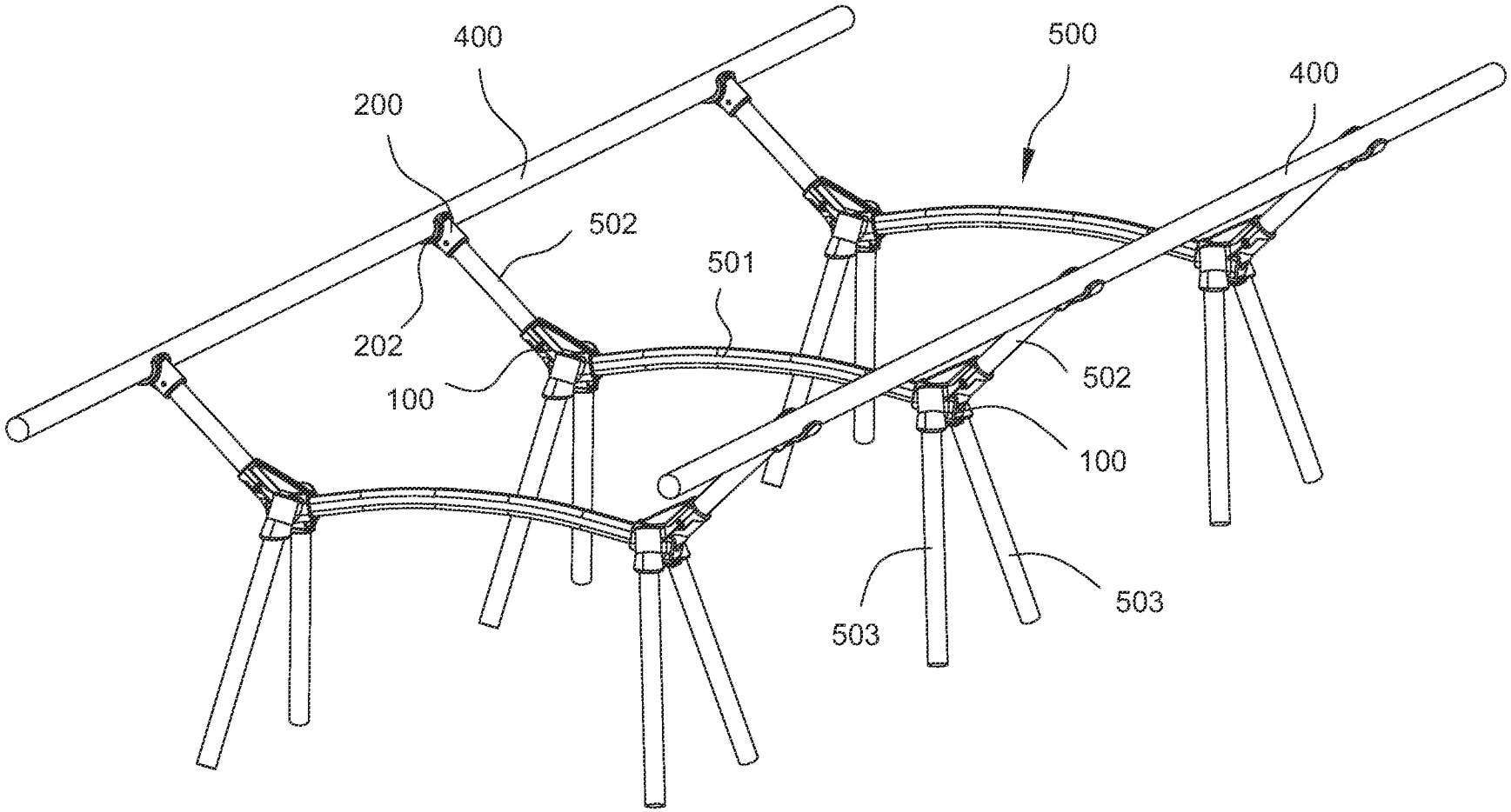
FIG. 1 is a perspective view of a supporting rod assembly according to Embodiment I of the present invention.

The present invention is further described below in combination with the accompanying drawings and embodiments.

A connecting piece 100 in the embodiment can be applied to various cots, and a tensioning piece 200 in the embodiment can also be applied to various cots that need to be disassembled and assembled. According to Embodiment I of a cot in the present invention, taking the cot applying both the connecting piece 100 and the tensioning piece 200 simultaneously as an example, explanations are made at the same time to the connecting piece 100, the tensioning piece 200 and the cot applying the connecting piece 100 and the tensioning piece 200. According to Embodiment II of the cot in the present invention, taking the cot applying the tensioning piece 200 as an example, explanations are made at the same time to the tensioning piece 200 and the cot applying the tensioning piece 200.

Embodiment I

As shown in FIG. 1 to FIG. 4, the cot in the embodiment comprises connecting pieces 100, a cot fabric (which is not shown in the figure, and may be a supporting surface made of various woven fabrics or other materials), a supporting rod assembly 500 and tensioning pieces 200.

Herein, the connecting pieces 100 are used in pairs when in use, and at least two pairs of connecting pieces 100 are oppositely disposed on both sides of the cot fabric. In the embodiment, three pairs of connecting pieces 100 are adopted, that is, six connecting pieces 100 are used. These three pairs of connecting pieces 100 are distributed at intervals along the length of the cot fabric. Herein, one pair of connecting pieces 100 is disposed corresponding to the middle of the cot fabric, and the other two pairs of connecting pieces 100 are respectively disposed at both ends of the cot fabric.

The supporting rod assembly 500 comprises a plurality of connecting rods 501, a plurality of supporting rods 502, a plurality of bed legs 503 and two side rods 400 of the cot, the number of which depends on actual needs.

Figure 2:
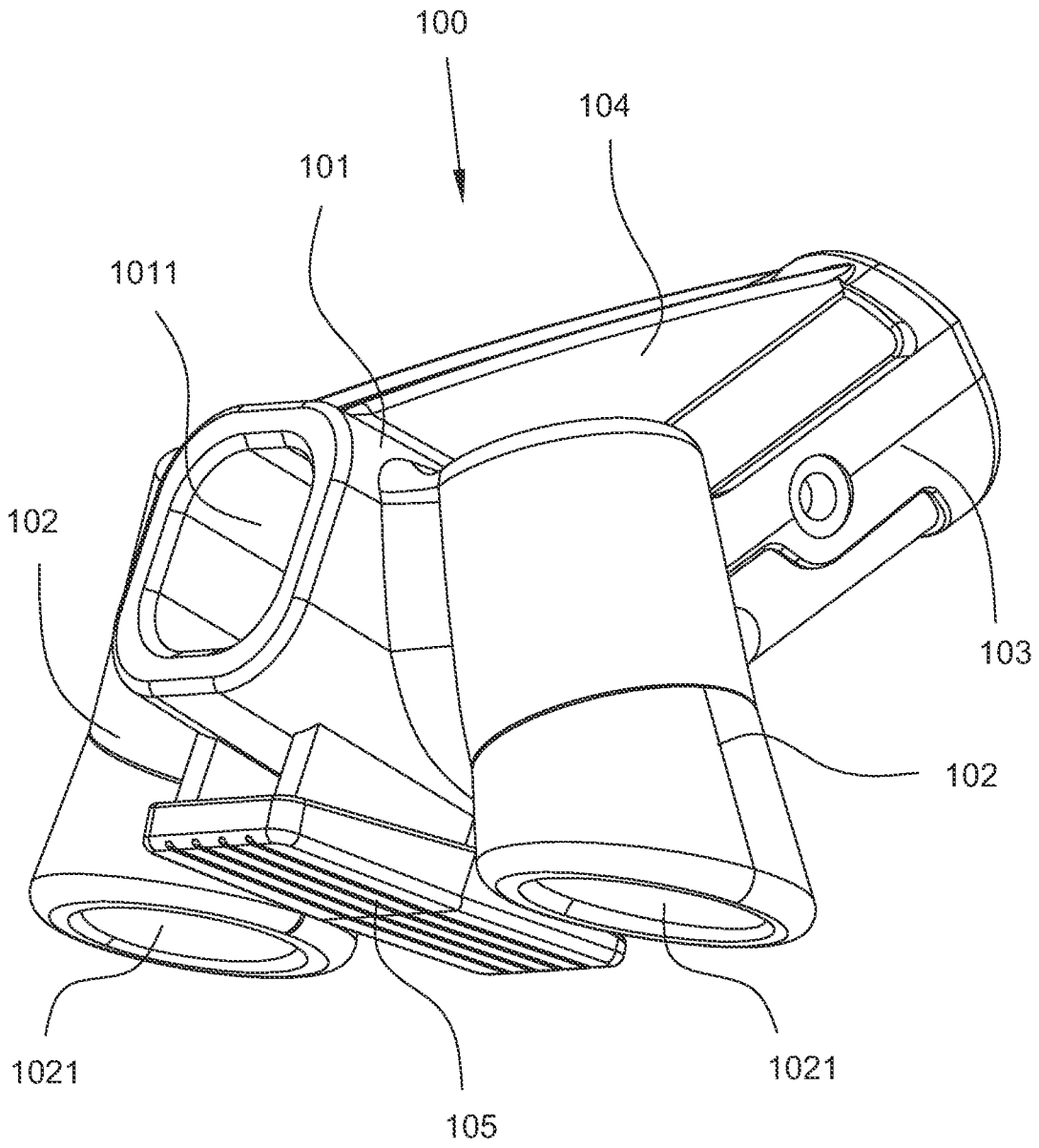
FIG. 2 is a perspective view of a connecting piece according to Embodiment I of the present invention.
Figure 3:
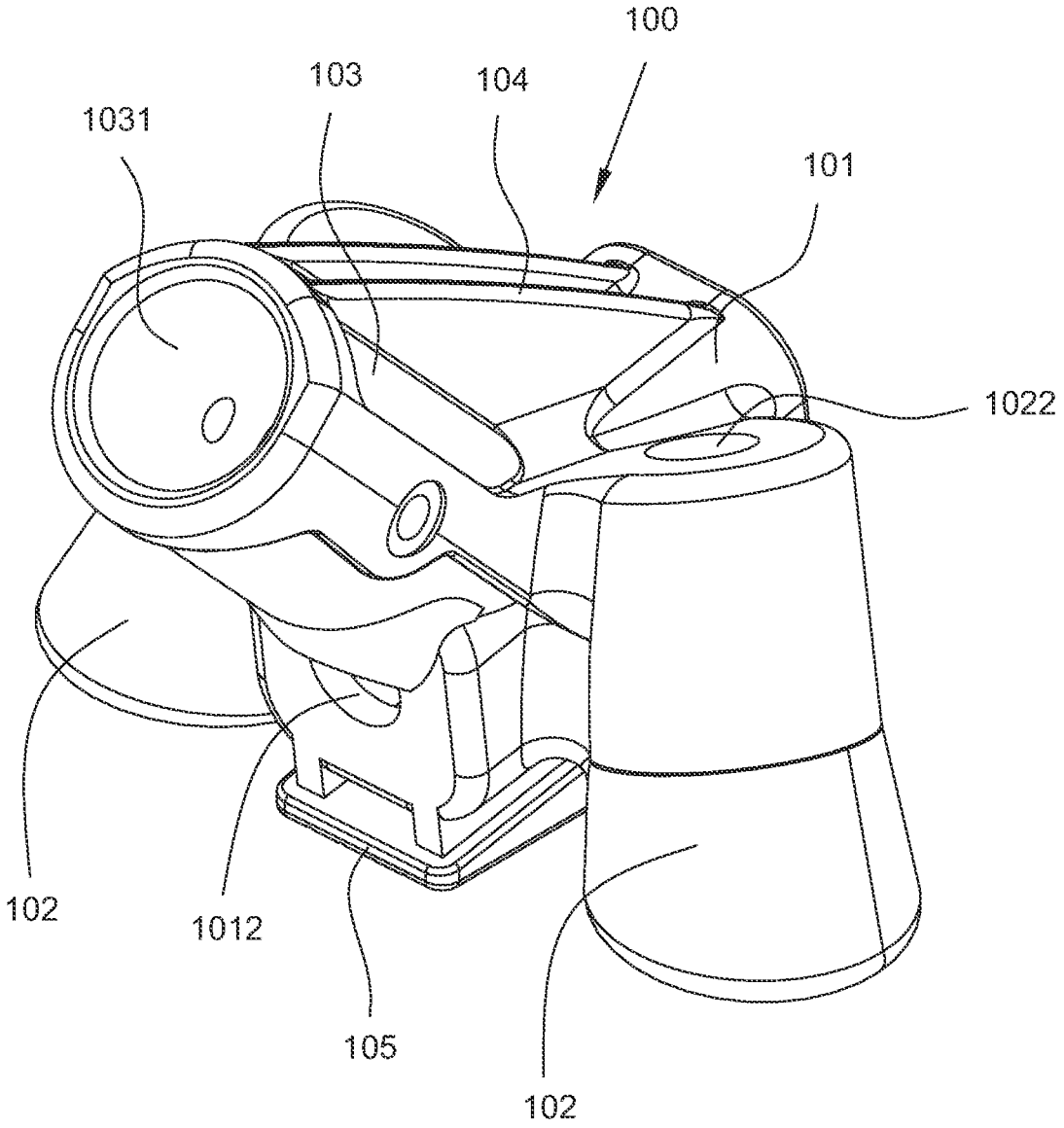
FIG. 3 is a perspective view of another angle of the connecting piece according to Embodiment I of the present invention.

As shown in FIG. 2 and FIG. 3, the connecting piece 100 comprises a first body 101, two supporting legs 102, and a supporting arm 103. The two supporting legs 102 are respectively connected to the left and right sides of the first body 101, and the supporting arm 103 is disposed at the rear of the top of the first body 101. In order to facilitate production and ensure structural firmness, the connecting piece 100 is an integral part, and the first body 101, the two supporting legs 102 and the supporting arm 103 are integrally injection molded.

The first body 101 has a first mounting hole 1011 opening forward with an axis extending along the horizontal direction. When in use, the openings of two connected first mounting holes 1011 in each pair of connecting pieces 100 are opposite to each other, and are configured to insert both ends of the connecting rod 501. The first body 101 has a first small hole 1012 at a rear end of the first mounting hole 1011, so that when the connecting rod 501 is inserted into the first mounting hole 1011, the situation that the connecting rod 501 cannot be mounted in place due to the air pressure in the first mounting hole 1011 can be avoided, and the connecting rod 501 can be inserted into the end of the first mounting hole 1011 based on the setting of the first small hole 1012.

Each supporting leg 102 has a low portion which is inclined outward. That is, the supporting leg 102 connected to the left side of the first body 101 is inclined leftward from top to bottom relative to the vertical direction, and the supporting leg 102 connected to the right side of the first body 101 is inclined rightward from top to bottom relative to the vertical direction. The supporting legs 102 on the connecting piece 100 can be directly supported on the ground, so that the inclined arrangement mode of the supporting legs 102 can ensure the stability of support on the ground. In order to further improve the support stability of the supporting legs 102 while reducing the friction to the connecting piece 100, the first body 101 has a supporting base 105 extending downward. The supporting base 105 extends along the axial direction of the first body 101. The length of the supporting base 105 is basically the same as the length of the first body 101, the bottom of the supporting base 105 is a plane, and the bottom of the supporting base 105 and the bottom of each supporting leg 102 are on the same horizontal plane.

In addition, each supporting leg 102 has a third mounting hole 1021 opening downward along the axial direction of the supporting leg 102, and the cot leg 503 may be mounted in the third mounting hole 1021. When in use, the height of the cot may be adjusted by mounting or dismounting the cot leg 503. In order to avoid the possibility that the connecting rod 501 cannot be mounted in place due to the air pressure in the third mounting hole 1021 when the cot leg 503 is mounted, each supporting leg 102 has a second small hole 1022 at a top end of the third mounting hole 1021.

The supporting arm 103 is located at the rear of the first body 101 and inclines upward and backward relative to the horizontal direction. The supporting arm 103 has a second mounting hole 1031 opening backward with an axis inclined upward relative to the horizontal direction, that is, the extension direction of the supporting arm 103 is consistent with that of the second mounting hole 1031. Meanwhile, a reinforcing rib 104 is connected between the first body 101 and a top surface of the supporting arm 103.

In addition, each supporting leg 102 has a third mounting hole 1021 opening downward along the axial direction of the supporting leg 102, and the cot leg 503 may be mounted in the third mounting hole 1021, so that the overall height of the cot fabric can be improved. When in use, the height of the cot may be adjusted by mounting or dismounting the cot leg 503. In order to avoid that the connecting rod 501 cannot be mounted in place due to the air pressure in the third mounting hole 1021 when the cot leg 503 is mounted, each supporting leg 102 has a second small hole 1022 at the end of the third mounting hole 1021.

The supporting arm 103 is located at the rear of the first body 101 and inclines upward and backward relative to the horizontal direction. The supporting arm 103 has a second mounting hole 1031 opening backward with an axis inclined upward relative to the horizontal direction, that is, the extension direction of the supporting arm 103 is consistent with that of the second mounting hole 1031. Meanwhile, a reinforcing rib 104 is connected between the first body 101 and the surface of the supporting arm 103.

In the embodiment, the cot fabric of the cot is made of cloth. Besides, a plurality of through holes are formed in both sides of the cot fabric, and the side rods 400 of the cot penetrate through the through holes. As shown in FIG. 1, the supporting rod assembly 500 comprises a plurality of connecting rods 501 each connected between each pair of connecting pieces 100, and a plurality of supporting rods 502 each connected between the connecting piece 100 and the corresponding side rod 400, and the cot legs 503 detachably connected to the supporting legs 102 and extend downward.

The two ends of the connecting rod 501 are respectively inserted into the first mounting holes 1011 of the corresponding pair of the connecting pieces 100. In the embodiment, the connecting rod 501 is arched upward, thus providing better supporting force when the cot fabric is pressed down.

The tensioning piece 200 is connected to the top of the supporting rod 502 and clamped in the bed body side rod 400 of the cot.

Figure 4:
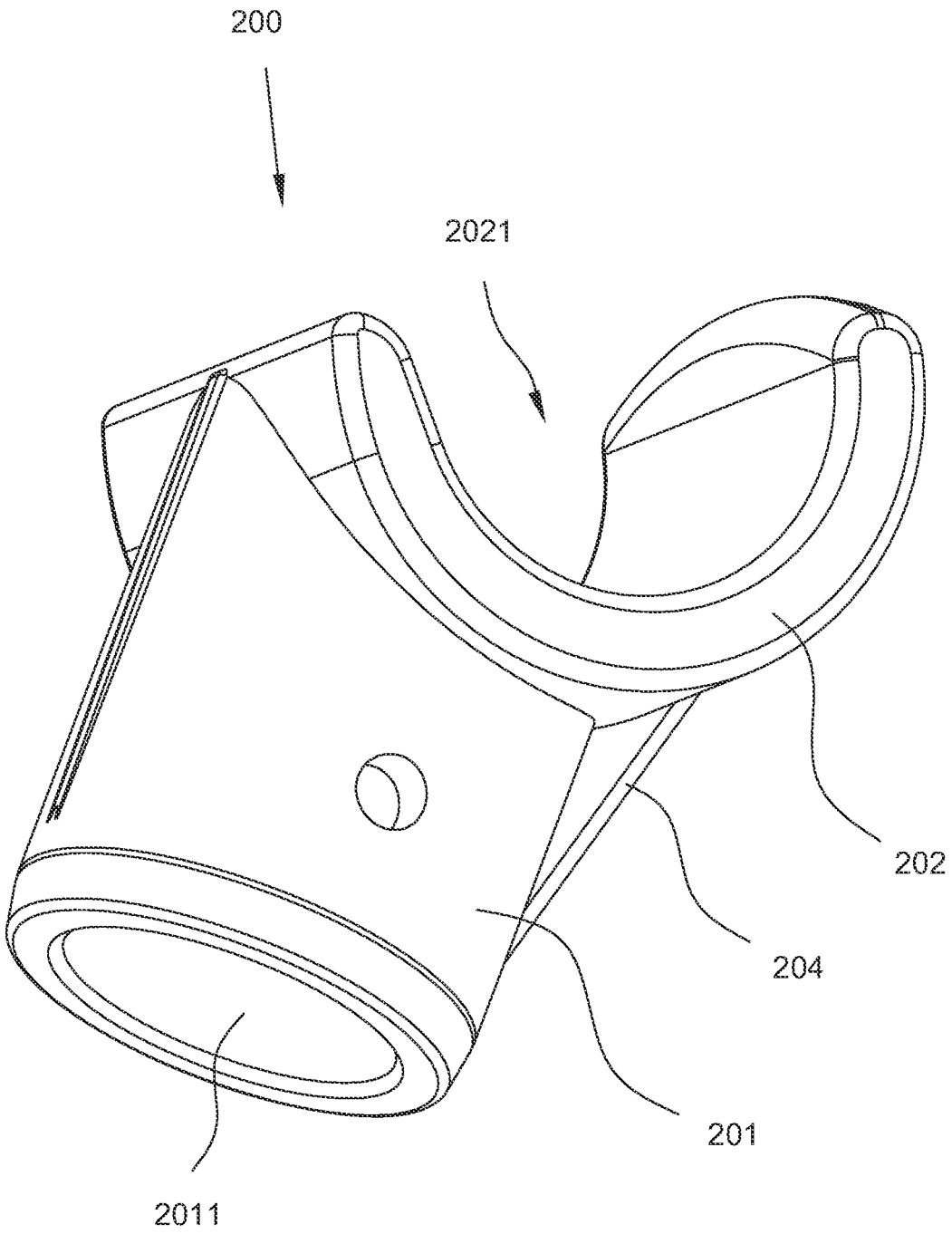
FIG. 4 is a perspective view of a tensioning piece according to Embodiment I of the present invention.

As shown in FIG. 4, in the embodiment, the tensioning piece 200 comprises a second body 201 and a clamping portion 202 connected to the second body 201; the second body 201 has a connecting hole 2011 for receiving a supporting rod 302 of the cot, the clamping portion 202 has an opening 2021 for clamping onto a side rod 400 of the cot, and the cross section of the inner wall of the opening 2021 is arc-shaped, and the radius of an inner wall of the opening 2021 of the clamping portion 202 matches with the radius of the side rod 400 of the cot.

Specifically, the clamping portion 202 is made of a material with certain elastic capacity, for example, the clamping portion 202 may be made of plastic, and the width of the top of the opening 2021 is slightly smaller than the diameter of the side rod 400 of the cot to ensure the firmness of the side rod 400 of the cot in the clamping portion 202. When in use, only a little force is applied to the side rod 400 of the cot to deform the clamping portion 202 so as to open the opening 2021, so that the side rod 400 of the cot is clamped in the clamping portion 202, and then the clamping portion 202 deforms and is reset. When disassembling is required, the side rod 400 of the cot is pulled out from the opening 2021 of the clamping portion 202 with a little force. The degree of curvature of the inner wall of the opening 2021 is between 90-170 degrees, preferably 150 degrees.

In the embodiment, the clamping portion 202 is extending upward from the top of the second body 201, so that the opening 2021 in the clamping portion 202 faces upward, and the center of the inner wall of the opening 2021 of the clamping portion 202 is located outside the axis of the second body 201, so that the side rod 400 of the cot can be clamped in the clamping portion 202 from top to bottom, which brings great convenience for operation. Besides, when a user lies on the cot fabric, under the action of the gravity of the user, the clamping portion 200 is slightly deformed and tightened inward, which improves the wrapping property of the side rod 400 of the cot and makes the side rod 400 of the cot more firmly fixed. The tensioning piece 200 enables the disassembly and assembly operations of the tensioning piece 200 and the side rod 400 of the cot to be easily implemented without additional tools when the cot is used, which greatly reduces the difficulty of disassembling and assembling the cot.

In addition, a reinforcing portion 204 is connected between the outer wall of the clamping portion 202 and the outer wall of the second body 201 so as to improve the strength of the tensioning piece 200. In the embodiment, the reinforcing portion 204 adopts a plate-shaped reinforcing rib.

The lower end of the supporting rod 502 is inserted into the second mounting hole 1031 of the connecting piece 100, so that the supporting rod 502 supports the connecting piece 100 and the cot fabric. Under the guidance of the axial extension direction of the second mounting hole 1031, the supporting rod 502 extends to the outside of the cot fabric from bottom to top, and the connecting piece 100 and the supporting rod assembly 500 do not occupy extra space outside the cot fabric, thus reducing the occupied area of the cot. At the same time, after the user lies on the cot fabric, the supporting rod 502 will continue to expand outward under the action of the gravity of the user, and then hold the bed surface tightly, so that the tightness of the bed surface is better and the flatness of the bed surface is better.

The cot leg 503 is connected in the third mounting hole 1021 of the supporting leg 102, so as to be mounted in the supporting leg 102. The user can choose to use the cot leg 503 according to his own needs. When the cot leg 503 is not used, the connecting piece 100 directly touches the bottom surface, and the height of the cot fabric is lower. When the cot leg 503 is used, the cot leg 503 forms a support under the connecting piece 100, which increase the height of the cot fabric.

When the cot using the connecting piece 100 is assembled, there is no need for additional tools, and fewer parts are required with fast connection speed, simple connection mode, easy operation and good stability during use.

Embodiment II

Figure 5:
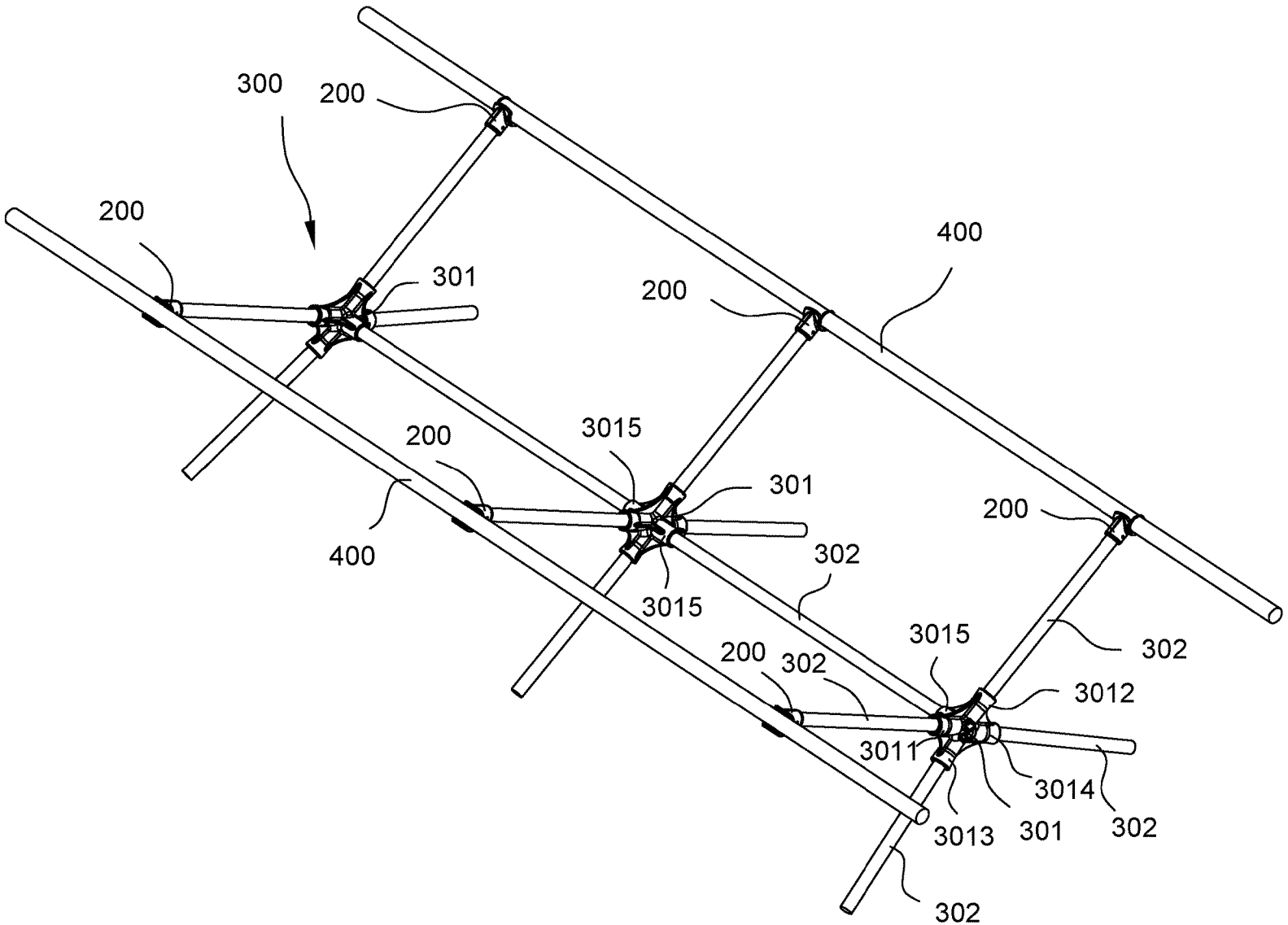
FIG. 5 is a perspective view of a supporting rod assembly according to Embodiment II of the present invention.

As shown in FIG. 5, the difference between the cot in the embodiment and that in the Embodiment I is: the cot comprises a plurality of tensioning pieces 200, a connection frame 300 and a cot fabric (which is not shown in the figure and may be a supporting surface made of various woven fabrics or other materials).

As shown in FIG. 5, the connection frame 300 comprises at least two joints 301 distributed along the length direction of the cot fabric, and a plurality of supporting rods 302 are connected between two adjacent joints 301, wherein each joint 301 has a first connecting protrusion 3011, a second connecting protrusion 3012, a third connecting protrusion 3013, a fourth connecting protrusion 3014 and a fifth connecting protrusion 3015, each for receiving the supporting rod 302. Herein, the joint 301 may be a block, and the first connecting protrusion 3011, the second connecting protrusion 3012, the third connecting protrusion 3013, the fourth connecting protrusion 3014 and the fifth connecting protrusion 3015 are directly formed therein. The joint 301 may also extend a column outward on a base block corresponding to the setting position of each connecting protrusion, and then form a groove body with an outward opening in the column to form a connecting groove. In the embodiment, the joint 301 with the latter structure is adopted, and the joint 301 may be integrally processed by a mold.

Herein, the first connecting protrusion 3011 and the second connecting protrusion 3012 extend and incline upward relative to the horizontal, and an included angle is defined between the central axes of the first connecting protrusion 3011 and the second connecting protrusion 3012 which are bilaterally symmetrical. The third connecting protrusion 3013 and the fourth connecting protrusion 3014 extend and incline downward relative to the horizontal, and an included angle is defined between the central axes of the third connecting protrusion 3013 and the fourth connecting protrusion 3014 which are bilaterally symmetrical. In addition, in order to ensure the support stability after the supporting rod 302 is connected, the central axes of the first connecting protrusion 3011, the second connecting protrusion 3012, the third connecting protrusion 3013 and the fourth connecting protrusion 3014 are in the same plane. The included angle between the central axes of the first connecting protrusion 3011 and the second connecting protrusion 3012 is an obtuse angle. The included angle between the central axes of the third connecting protrusion 3013 and the fourth connecting protrusion 3014 is an obtuse angle. The included angle between the central axes of the first connecting protrusion 3011 and the second connecting protrusion 3012 is equal to the included angle between the central axes of the third connecting protrusion 3013 and the fourth connecting protrusion 3014. Thus, the central connecting lines of the first connecting protrusion 3011, the second connecting protrusion 3012, the third connecting protrusion 3013 and the fourth connecting protrusion 3014 can form an X shape.

The fifth connecting protrusion 3015 extends horizontally forward and/or backward, that is, the axial center line of the fifth connecting protrusion 3015 is respectively perpendicular to the axial center lines of the first connecting protrusion 3011, the second connecting protrusion 3012, the third connecting protrusion 3013 and the fourth connecting protrusion 3014. The extension direction of the fifth connecting protrusion 3015 is specifically set as required. If the joint 301 is applied to the middle position, and the supporting rods 302 need to be connected at both sides of the joint 301 to support and connect with other joints 301, the fifth connecting protrusion 3015 is disposed horizontally extending forward and backward in the joint 301. If the joint 301 is used in the end position, the fifth connecting protrusion 3015 only needs to be disposed horizontally extending forward or backward in the joint 301.

In addition, when the supporting rod 302 is mounted in each connecting protrusion, since the supporting rod 302 needs to be tightly fitted with the connecting protrusion to ensure the connection firmness, the space between the supporting rod 302 and the bottom of the connecting protrusion will be compressed to form a certain air pressure when the supporting rod 302 is inserted into the connecting protrusion, so that the supporting rod 302 cannot be inserted into the bottom of the connecting protrusion. To avoid this situation, a plurality of cavities are correspondingly disposed outside the bottoms of the first connecting protrusion 3011, the second connecting protrusion 3012, the third connecting protrusion 3013 and the fourth connecting protrusion 3014 in the joint 301, and a plurality of small holes communicating with the corresponding cavities are disposed at the bottoms of the first connecting protrusion 3011, the second connecting protrusion 3012, the third connecting protrusion 3013 and the fourth connecting protrusion 3014. Thus, when in use, the situation that the supporting rod 302 cannot be inserted in place into the connecting protrusion can be effectively avoided.

In addition, in order to improve the strength of the joint 301, connecting ribs are connected between the outer surface of the fifth connecting protrusion 3015 and the outer surfaces of the first connecting protrusion 3011, the second connecting protrusion 3012, the third connecting protrusion 3013 and the fourth connecting protrusion 3014.

The use method of the joints 301 on the cot is: one joint 301 with two fifth connecting protrusions 3015 and two joints 301 with one fifth connecting protrusion 3015 are used. For convenience, the joint 301 with two fifth connecting protrusions 3015 is called a first joint 301, and the joint 301 with one fifth connecting protrusion 3015 is called a second joint 301. Two second joints 301 are respectively placed on both sides of the first joint 301, and the fifth connecting protrusions 3015 in the second joints 301 are respectively placed facing the first joint 301. A supporting rod 302 is horizontally inserted into each of the two fifth connecting protrusions 3015 of the first joint 301, and the outer ends of the two supporting rods 302 are inserted into the fifth connecting protrusions 3015 of the first joint 301, so that three joints 301 are connected together with two supporting rods 302, and the total length constituted is substantially consistent with the total length of the cot. Then, the supporting rods 302 are inserted into the first connecting protrusion 3011, the second connecting protrusion 3012, the third connecting protrusion 3013 and the fourth connecting protrusion 3014 of each joint 301, respectively, and the supporting rods 302 inserted into the third and fourth connecting protrusions 3013 and 3014 of the three joints 301 can be supported on the ground, thus forming ground support. The upper ends of the supporting rods 302 inserted in the first connecting protrusions 3011 and the second connecting protrusions 3012 of the three joints 301 are all connected with a tensioning piece 200 to be fastened to the side rod 400 of the cot. These two supporting rods 302 support the cot fabric through the tensioning piece 200 respectively, thus implementing the assembly of the cot.

Thus, it is to be seen that when the cot using the tensioning piece 200 and the connection frame 300 is assembled, there is no need for additional tools, and fewer parts are required with fast connection speed, simple connection mode and easy operation. The service life is long as the joints 301 do not touch the ground. During use, the stability is good, and the service life is long.

The invention claimed is:

1. A connecting piece, comprising:

a first body (101) having a left side and a right side;

two supporting legs (102) respectively connected to the left and right sides of the first body (101);

a supporting arm (103) connected to the first body (101) and extending upward;

wherein, the first body (101) has a first mounting hole (1011) opening forward with an axis extending along the horizontal direction; and the supporting arm (103) has a second mounting hole (1031) opening backward with an axis inclined upward relative to the horizontal direction.

2. The connecting piece of claim 1, wherein the supporting arm (103) is located at the rear of the first body (101) and inclines upward and backward relative to the horizontal direction.

3. The connecting piece of claim 1, wherein the first body (101) has a first small hole (1012) at a rear end of the first mounting hole (1011).

4. The connecting piece of claim 1, wherein a reinforcing rib (104) is connected between the first body (101) and a top surface of the supporting arm (103).

5. The connecting piece of claim 1, wherein the first body (101) has a supporting base (105) at the bottom of the first body (101), and the bottom of the supporting base (105) and the bottom of each supporting leg (102) are on the same horizontal plane.

6. The connecting piece of claim 1, wherein each supporting leg (102) has a low portion which is inclined outward.

7. The connecting piece of claim 6, wherein each supporting leg (102) has a third mounting hole (1021) opening downward.

8. The connecting piece of claim 7, wherein each supporting leg (102) has a second small hole (1022) at a top end of the third mounting hole (1021).

9. A cot, comprising a cot fabric, a supporting rod assembly (500), a plurality of connecting pieces (100) of claim 1 and a plurality of tensioning pieces (200) located above the connecting pieces (100);

wherein, at least two pairs of connecting pieces (100) are disposed face to face, and each pair of connecting pieces (100) is distributed at intervals along the length of the cot fabric;

two side rods (400) are respectively disposed at two sides of the cot fabric;

the supporting rod assembly (500) comprises a plurality of connecting rods (501) each connected between each pair of connecting pieces (100), and a plurality of supporting rods (502) each connected between the connecting piece (100) and the corresponding side rod (400);

the two ends of each connecting rod (501) are respectively inserted into the first mounting hole (1011) of the connecting pieces (100); and the two ends of the supporting rods (502) are respectively inserted into a connecting hole (2011) of the tensioning pieces (200) and the second mounting hole (1031) of the connecting pieces (100);

each side rod (400) is clamped inside a opening (2021) of a clamping portion (202) of each tensioning piece (200) so as to fasten the cot fabric.

10. The cot of claim 9, wherein the supporting rod assembly (500) further comprises a plurality of cot legs (503) detachably connected to the supporting legs (102) and extending downward.

* * * * *